US009972225B2

(12) United States Patent
Kiyotomo

(10) Patent No.: US 9,972,225 B2
(45) Date of Patent: May 15, 2018

(54) METHOD FOR FORMING BAND-SHAPED LABEL SET AND LABEL ROLL

(71) Applicant: WE'LL CORPORATION, Ishikawa (JP)

(72) Inventor: Norikazu Kiyotomo, Tokyo (JP)

(73) Assignee: WE'LL CORPORATION, Hakusan-shi, Ishikawa (JP)

( * ) Notice: Subject to any disclaimer, the term of this patent is extended or adjusted under 35 U.S.C. 154(b) by 0 days. days.

(21) Appl. No.: 15/449,330

(22) Filed: Mar. 3, 2017

(65) Prior Publication Data

US 2017/0178548 A1 Jun. 22, 2017

Related U.S. Application Data

(63) Continuation of application No. 14/652,525, filed as application No. PCT/JP2013/078783 on Oct. 24, 2013, now abandoned.

(30) Foreign Application Priority Data

Dec. 18, 2012 (JP) ..... 2012-275432

(51) Int. Cl.
*G09F 3/10* (2006.01)
*G09F 3/02* (2006.01)

(52) U.S. Cl.
CPC ..... *G09F 3/10* (2013.01); *G09F 2003/023* (2013.01); *G09F 2003/0222* (2013.01);
(Continued)

(58) Field of Classification Search
CPC .. B31D 1/02; B31D 1/021; G09F 3/10; G09F 3/02; G09F 2003/0222; B65C 2009/1888;
(Continued)

(56) References Cited

U.S. PATENT DOCUMENTS 2,170,147 A 8/1939 Lane
5,324,078 A 6/1994 Bane
(Continued)

FOREIGN PATENT DOCUMENTS

JP 54-124499 U1 8/1979
JP 04-232986 A 8/1992
(Continued)

OTHER PUBLICATIONS

Machine translation of JP 11249572 date unknown.*
(Continued)

*Primary Examiner* — John Goff
(74) *Attorney, Agent, or Firm* — Bruzga & Associates; Charles E. Bruzga; Shlomo S. Moshen

(57) ABSTRACT

One exemplary goal of the disclosed inventions is to reduce the amount of waste matter in a label to be attached to an adherend with part of the label protruding. A label is to be attached to an adherend with part of the label protruding and includes a label base section and an overcoat layer provided on the front surface of the label base section, and the back surface of the label base section is provided with a first adhesive section formed from a coating of a first paste (self-adhesive paste) which remains self-adhesive after coating, and a second adhesive section formed from a coating of a second paste (adhesive paste), which cures when a predetermined time duration elapses.

5 Claims, 8 Drawing Sheets

(52) U.S. Cl.
CPC ..... *G09F 2003/0229* (2013.01); *G09F 2003/0266* (2013.01)

(58) Field of Classification Search
CPC ..... B65C 9/18; Y10T 156/1089; Y10T 156/1092; B29C 65/76; B32B 37/0076
USPC ..... 156/314, 315
See application file for complete search history.

(56) References Cited

U.S. PATENT DOCUMENTS

| | | | |
|---|---|---|---|
| 6,037,042 | A | 3/2000 | Kato et al. |
| 6,280,549 | B1 | 8/2001 | Langan |
| 6,379,790 | B1 | 4/2002 | Langan |
| 2005/0123706 | A1 | 6/2005 | Masuda et al. |
| 2006/0234014 | A1 | 10/2006 | Liu et al. |
| 2006/0263594 | A1 | 11/2006 | Kraft et al. |
| 2012/0114891 | A1 | 5/2012 | Smith |

FOREIGN PATENT DOCUMENTS

| | | | | |
|---|---|---|---|---|
| JP | 11249572 | A | * | 9/1999 |
| JP | 11-344930 | A | | 12/1999 |
| JP | 3205804 | B2 | | 9/2001 |
| JP | 2002-088323 | A | | 3/2002 |
| JP | 2002-099215 | A | | 4/2002 |
| JP | 2004-004933 | A | | 1/2004 |
| JP | 2007-065089 | A | | 3/2007 |
| JP | 2008-537170 | A | | 9/2008 |
| JP | 2011-068786 | A | | 4/2011 |
| JP | 3177283 | U | | 7/2012 |
| WO | 2010082533 | A1 | | 7/2010 |
| WO | 2010101101 | A1 | | 9/2010 |
| WO | 2011038710 | A1 | | 4/2011 |

OTHER PUBLICATIONS

International Search Report, dated Jan. 14, 2014 for PCT Application No. PCT/JP2013/078783.
International Search Report, dated Jan. 14, 2014 for PCT Application No. PCT/JP2013/078782.
International Preliminary Report on Patentability, dated Jun. 23, 2015 for PCT Application No. PCT/JP2013/078783.
International Preliminary Report on Patentability, dated Jun. 23, 2015 for PCT Application No. PCT/JP2013/078782.
European Search Report, dated Jun. 6, 2016, for EP Application No. 13864168.
Office action, dated Apr. 7, 2017, for EP Application No. 13864168.
First Office action, dated Mar. 2, 2017, for CN Application No. 201380066708.
Second Office action, dated Nov. 13, 2017, for CN Application No. 201380066708.

* cited by examiner

METHOD FOR FORMING BAND-SHAPED LABEL SET AND LABEL ROLL

FIELD OF THE INVENTION

The field relates to a label, a band-shaped label set, and a label roll, and particularly relates to: a product advertisement label to be attached to an adherend such as a commercial product with the label protruding from the product; a band-shaped label set formed by connecting a plurality of said labels; and a label roll configured by rolling up the band-shaped label set into a roll shape.

BACKGROUND OF THE INVENTION

In the past, products displayed in stores have widely used product advertisement labels to be attached to commercial products with the label protruding from the product, such labels being disclosed in, for example, Patent Document 1. In the label (partially pasted label) disclosed in Patent Document 1, a printed section on which the slogan or the like is printed is formed on the front surface, and formed on the back surface are an adhesive section that can be attached to the product and a non-adhesive section that cannot be attached to the product. This label is designed to be used with part of the label (the non-adhesive section) protruding from the product and the adhesive section being attached to the product.

With the product advertisement label described above, there is a tendency to form a larger region protruding from the product in order to increase the in-store promotional effect, and there are labels in which, for example, the surface area of the adhesive section formed on the back surface of the label does not constitute 20% of the entire back surface of the label.

PRIOR ART DOCUMENTS

Patent Documents

Patent Document 1 refers to: Utility Model Registration No. 3177283.

SUMMARY OF THE INVENTION

In one example, a label to be attached to an adherend with part of the label protruding, the label comprises: a label base section; an overcoat layer being provided on the front surface of the label base section; and a first adhesive section being formed with a coating of a first paste which remains self-adhesive, and a second adhesive section being formed with a coating of a second paste, which cures with the elapsing of a predetermined time duration, being provided on the back surface of the label base section.

In one example, a band-shaped label set formed by connecting a plurality of the labels according to claim 1, the band-shaped label set comprising:

the plurality of labels being connected to each other by disposing the front and back surfaces of the labels so as to partially overlap, and causing the overcoat layer of the next adjacently disposed label to adhere to the first adhesive section and the second adhesive section formed on the back surface of each label base section, from the time the second adhesive section is formed until the elapsing of a predetermined time duration; and release paper being attached to the back surfaces of the connected labels.

In one example, a label roll configured by rolling up a band-shaped label set formed by connecting a plurality of the labels according to claim 1, the label roll comprising:

the band-shaped label set being formed by disposing the front and back surfaces of the labels so as to partially overlap, and causing the overcoat layer of the next adjacently disposed label to adhere to the first adhesive section and the second adhesive section formed on the back surface of each label base section, from the time the second adhesive section is formed until the elapsing of a predetermined time duration; and the label roll being formed by rolling up the band-shaped label set into a roll shape after the second adhesive section of each label constituting the band-shaped label set has cured.

BRIEF DESCRIPTION OF THE DRAWINGS

Further features and advantages of the invention will become apparent from reading the following detailed description in conjunction with the following drawings, in which like reference numbers refer to like parts.

DETAILED DESCRIPTION

Figure 1:
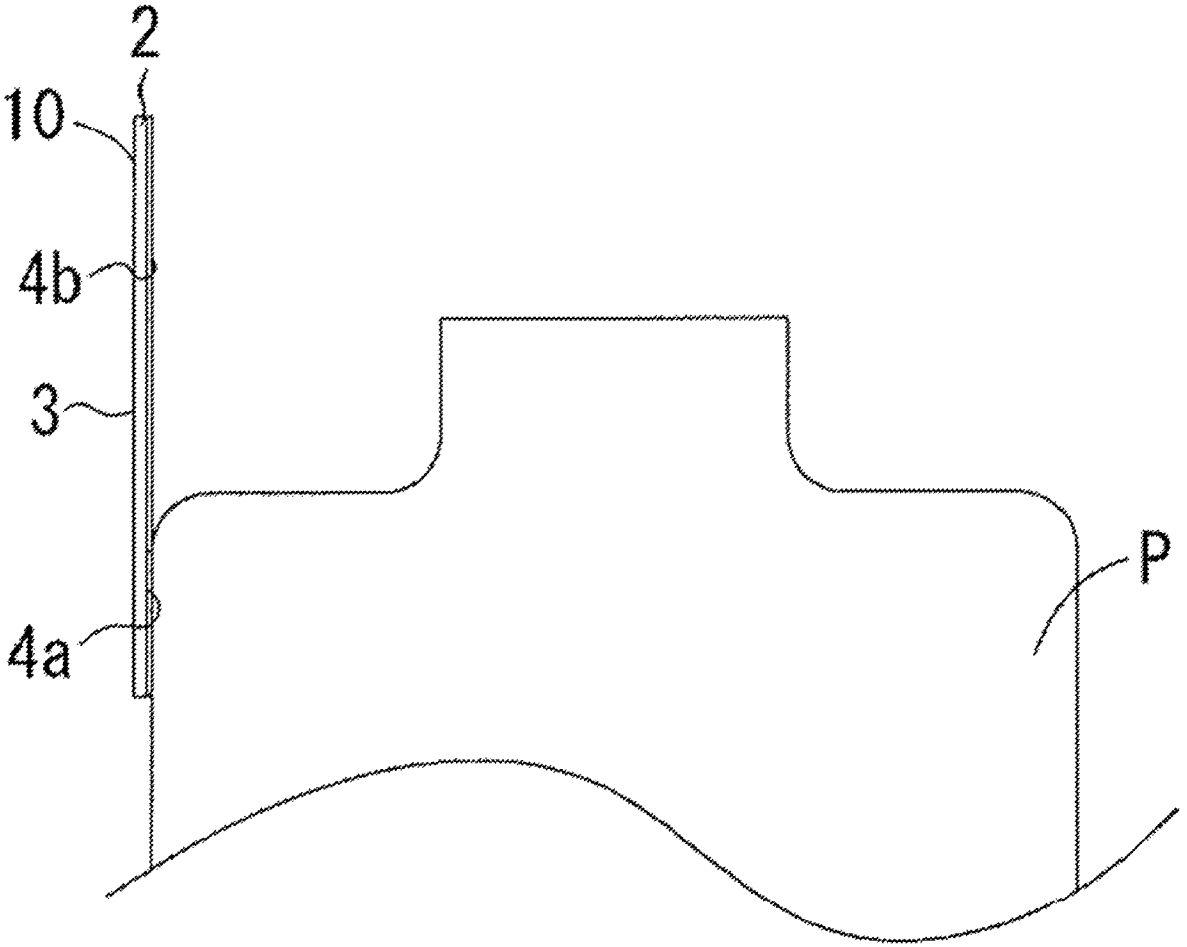
FIG. 1 is a schematic view showing the label of the first embodiment of the present invention as being attached to a product.

The examples and drawings provided in the detailed description are merely examples, and should not be used to limit the scope of the claims in any claim construction or interpretation.

PROBLEMS TO BE SOLVED BY THE INVENTION

However, the partially pasted product advertisement label of the prior art described above has the following technical problems. Specifically, in the partially pasted label described above, the adhesive section is only formed on part of the back surface, and adhesive force is weaker than in the case of a label where the adhesive section is formed over the entire back surface. Therefore, when a band-shaped label set is formed, the set being disposed so as to partially overlap the front and back surfaces of a plurality of labels, and the labels being connected to each other in the set, a technical problem is that the adhesive force between connected labels is weak and the labels separate from each other. Therefore, it has been difficult in the partially pasted label described above to form a band-shaped label set and roll up the formed band-shaped label set into a roll shape to form a label roll. It is extremely difficult to form a band-shaped label set, particularly in the case of a label where the surface area of the adhesive section of the back surface of the label does not constitute 20% of the entire back surface of the label. As a result, partially pasted labels such as that described above have employed configurations in which release paper is attached one sheet at a time, and an environmental problem has been that release paper leads to large amounts of waste matter.

The present invention was devised in view of the technical problems described above, and an object thereof is to reduce the amount of waste matter in a label to be attached to an adherend with part of the label protruding.

MEANS USED TO SOLVE THE ABOVE-MENTIONED PROBLEMS

The present invention for solving the technical problems described above is a label to be attached to an adherend with part of the label protruding, the label characterized in having a label base section and an overcoat layer provided on the front surface of the label base section; and the label also characterized in that a first adhesive section formed with a coating of a first paste which remains self-adhesive and a second adhesive section formed with a coating of a second paste which cures with the elapse of a predetermined time duration are provided on the back surface of the label base section. The first paste is preferably formed from a rubber hot melt adhesive or a UV-cured acrylic hot melt adhesive, and the second paste is preferably formed from an olefin adhesive.

Thus, in the label of the present invention, the first adhesive section which remains self-adhesive and the second adhesive section formed with a coating of second paste which cures with the elapsing of the predetermined time duration is provided on the back surface of the label base section. Specifically, until the predetermined time duration elapses, the label of the present invention has the same function as the case of a label where an adhesive section is formed over the entire back surface of the label. With this configuration, from the time the second adhesive section is formed until the elapsing of the predetermined time duration, when a plurality of labels are connected to each other with the front and back surfaces of the labels disposed so as to partially overlap, a band-shaped label set may be formed where the labels are connected to each other with stronger adhesive force than when a plurality of partially pasted labels of the prior art described above are connected. Therefore, for example, this band-shaped label set can be rolled up into a roll shape to form a label roll, a label roll that does not use release paper can thereby be provided, and release paper that becomes waste matter can be reduced. Because the second adhesive section cures when the predetermined time duration elapses, the second adhesive section is incapable of adhering to the adherend when the label is attached to the adherend. Therefore, when the label of the present invention is attached to a product, the first adhesive section can be attached to the product with the second adhesive section incapable of adhering protruding from the product, and the label can be made to function as a product advertisement label.

In addition to the first adhesive section and the second adhesive section, a paste-free section not coated with paste is preferably formed on the back surface of the label base section. The reasons for such a configuration are as follows. Specifically, the plurality of labels must be connected to each other with adhesive force sufficient to prevent them from easily separating when, for example, the tip end of the band-shaped label set formed by the labels is pulled. Therefore, if the labels are connected to each other with adhesive force sufficient to prevent them from easily separating, there is no need for the second adhesive section to be formed over the entire region of the label back surface that excludes the first adhesive section. Therefore, in accordance with the size and shape of the label, the second adhesive section is provided on a region necessary for adhesion between labels and the rest of the region (excluding the first adhesive section and the second adhesive section) is made into a paste-free section, whereby the surface area over which the second adhesive section is formed is smaller and the amount of tackifier for forming the second adhesive section is reduced. The cost of manufacturing the labels can thereby be lowered.

In one example of the present invention, a band-shaped label set is formed by connecting a plurality of labels, and is characterized in that: the plurality of labels are connected to each other by disposing the front and back surfaces of the labels so as to partially overlap, and causing the overcoat layer of the next adjacently disposed label to adhere to the first adhesive section and second adhesive section formed on the back surface of each label base section, from the time the second adhesive section is formed until the elapse of a predetermined time duration; and release paper is attached to the back surfaces of the connected labels.

In the configuration of the band-shaped label set described above, because the band-shaped label set is connected with the front and back surfaces of a plurality of labels disposed so as to partially overlap, the size (surface area) of the release paper can be smaller than when the release paper is attached one sheet at a time, as is the case in the partially pasted label of the prior art described above. As a result, with the configuration of the present invention, the amount of waste matter can be reduced in a label to be attached to an adherend with part of the label protruding.

The present invention is also a label roll configured by rolling up a band-shaped label set in which a plurality of the labels are connected, and is characterized in that the band-shaped label set is formed by disposing the front and back surfaces of the labels so as to partially overlap, and causing the overcoat layer of the next adjacently disposed label to adhere to the first adhesive section and second adhesive section formed on the back surface of each label base section, from the time the second adhesive section is formed until the elapse of a predetermined time duration; and the label roll is formed by rolling up the band-shaped label set into a roll shape after the second adhesive section of each label constituting the band-shaped label set has cured.

In each label constituting the label roll L with the configuration described above, the region S1 of the first adhesive section that overlaps the front surface of the next label and a region S2 of the second adhesive section that overlaps the front surface of the next label are caused to adhere to the next label of the same layer. In each label, a region S3, which is the rest of the first adhesive section other than the region S1, is adhered to a label disposed in a lower layer. Specifically, the present invention has a configuration in which labels of the same layer are adhered to each other through "the region S1 of the first adhesive section and the region S2 of the second adhesive section," and labels of an upper and lower layer are adhered to each other through only the region S3 of the first adhesive section. Therefore, in the present invention, the adhesive force between labels connected in the same layer can be made stronger than the adhesive force between labels connected in an upper and lower layer.

As a result, in the present invention, when the tip end of the label roll is pulled and the band-shaped label set is drawn out, each label constituting the band-shaped label set remains in place without peeling away from the label disposed in the lower layer, and there can be fewer instances of the band-shaped label set being cut off. Therefore, in the present invention, product advertisement labels may be automatically attached to an adherend with the use of equipment for the self-adhering of labels. Specifically, the configuration of the label roll of the present invention reduces the possibility of labels being cut off when the equipment for the self-adhering of labels draws out the tip end of the label roll, the automatic process for the self-adhering of labels is not frequently interrupted midway through, and the automatic process for the self-adhering of labels can be performed efficiently.

EFFECT OF THE INVENTION

With the configuration of the present invention, the amount of waste matter in a label to be attached to an adherend with part of the label protruding may be reduced.

BEST MODE FOR CARRYING OUT THE INVENTION

Embodiments of the present invention are described below using the accompanying drawings. The label 10 of the present embodiment is a product advertisement label (a so-called "attention label") to be attached to a product with part of the label protruding from the product. The band-shaped label set 8 of the present embodiment is formed into a band shape by connecting a plurality of product advertisement labels 10 and a label roll L is configured by rolling up the band-shaped label set 8 into a roll shape. First, the first embodiment of the present invention is described using FIGS. 1 to 4.

Figure 2:
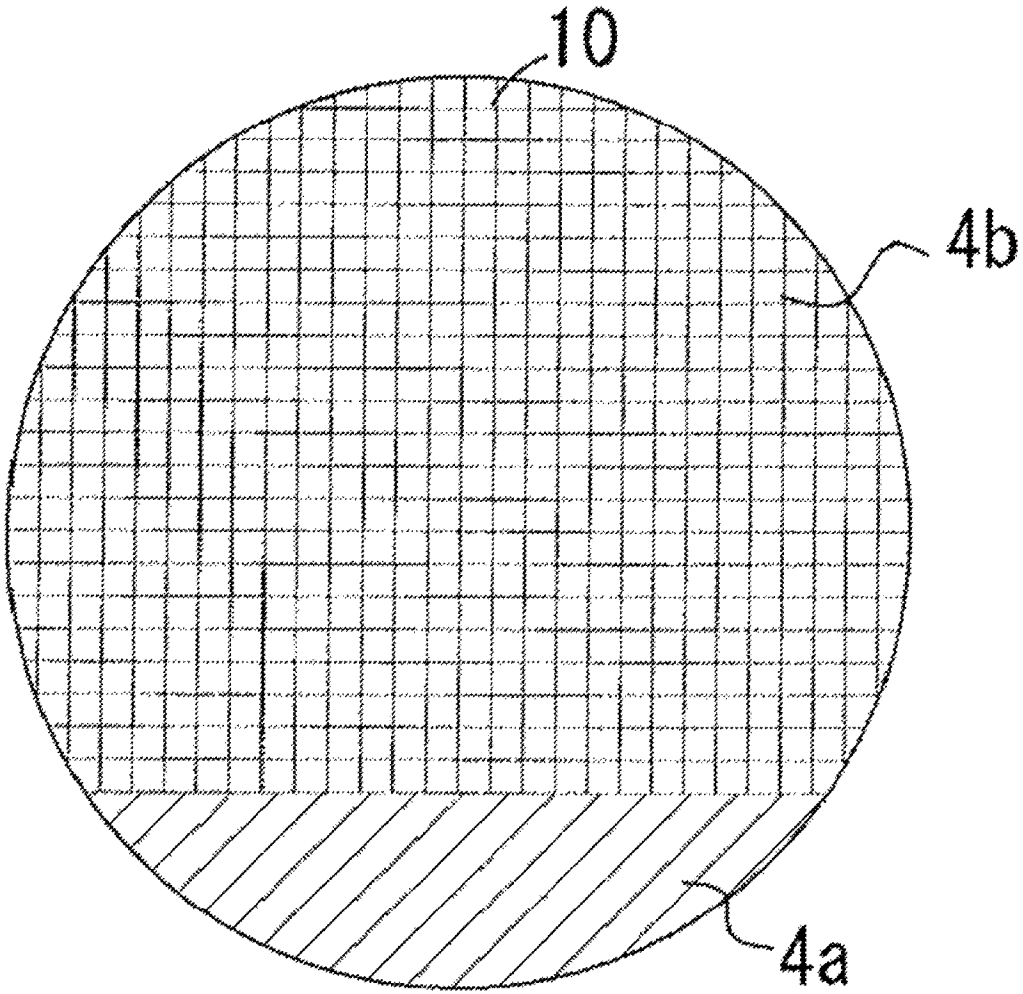
FIG. 2 is a schematic view showing the back surface of the label of the first embodiment of the present invention.

The label 10 of the first embodiment comprises a label base section 2 having a printed section in which the slogan, capability, or other features of the product are printed, and an overcoat layer 3 provided on the front surface of the label base section 2, as shown in FIG. 1. Provided on the back surface of the label base section 2 are a first adhesive section 4*a* formed from a coating of a first paste (self-adhesive paste) which remains self-adhesive after coating, and a second adhesive section 4*b* formed from a coating of a second paste (adhesive paste), which cures when a predetermined time duration (e.g., 30 to 40 seconds) elapses after coating, as shown in FIGS. 1 and 2.

In the first embodiment, the surface area of the first adhesive section 4*a* is about 20% of the entire back surface of the label 10, and the surface area of the second adhesive section 4*b* is about 80% of the entire back surface of the label 10, but this percentage of the surface area of the first adhesive section 4*a* and the second adhesive section 4*b* relative to the entire back surface is ultimately one example. The printed section may be formed on the front surface of the label base section 2, or it may be formed on the back surface of the label base section 2 (for example, when the label base section 2 is a transparent film or the like, the printed section is visible from the front surface of the label 10 irrespective of whether the printed section is formed on the front surface of the label base section 2 or the back surface of the label base section 2).

In the first embodiment, the second adhesive section 4*b* is self-adhesive until a predetermined time duration elapses following the coating of the back surface of the label base section 2 (is self-adhesive during the manufacturing stage) and cures after the predetermined time duration has elapsed, and is therefore incapable of adhering to the adherend when the label 10 is attached to the adherend. Specifically, the label 10 is configured and comprises an adhesive section (the first adhesive section 4*a*) in which only part of the back surface of the label can self-adhere to the adherend in the stage when the label is actually used. Therefore, when the label 10 is attached to a product P as shown in FIG. 1, the first adhesive section 4*a* can be attached to the product P and the label 10 can be made to function as a product advertisement label with the second adhesive section 4*b*, which is incapable of adhesion, protruding from the product P.

The label base section 2 is formed from, for example, a polyester film (PET (polyethylene terephthalate)) having a thickness dimension of "30 to 80 μm," a polypropylene film having a thickness dimension of "50 to 90 μm," synthetic paper having a thickness dimension of "40 to 80 μm," or the like. The overcoat layer 3 is formed on the front surface of the label base section 2 by forming a coating of an overcoat agent. This overcoat agent can be, for example, a UV varnish, an aqueous varnish, or the like. The thickness dimension of the overcoat layer 3 is formed to, for example, "1 to 2 μm."

For example, a rubber hot melt adhesive or a UV-curing acrylic hot melt adhesive is used for the first paste (self-adhesive paste) forming the first adhesive section 4*a*. An "adhesive paste which has an adhesive function but cures (or dries) after coating and the elapsing of a predetermined time duration and is thereafter non-adhesive" is used for the second paste (adhesive paste) forming the second adhesive section 4*b*. For example, an olefin adhesive (for example, "MORESCO-MELT (registered trademark) AC-856, 857" made by MORESCO Corporation) can be used for the second adhesive paste.

With the configuration of the label 10 of the first embodiment, the band-shaped label set 8 (see FIG. 3) in which a plurality of labels 10 are connected to each other can be formed by disposing the front and back surfaces of the labels 10 so as to partially overlap from the time the second adhesive section 4*b* is formed on the back surface of the label 10 until the elapsing of the predetermined time duration (e.g. 30 to 40 seconds), and causing the adhesive section (the first adhesive section 4*a* and the second adhesive section 4*b*) formed on the back surface of each label 10 to adhere to the overcoat layer 3 of the next label 10 disposed adjacent thereto.

Figure 3:
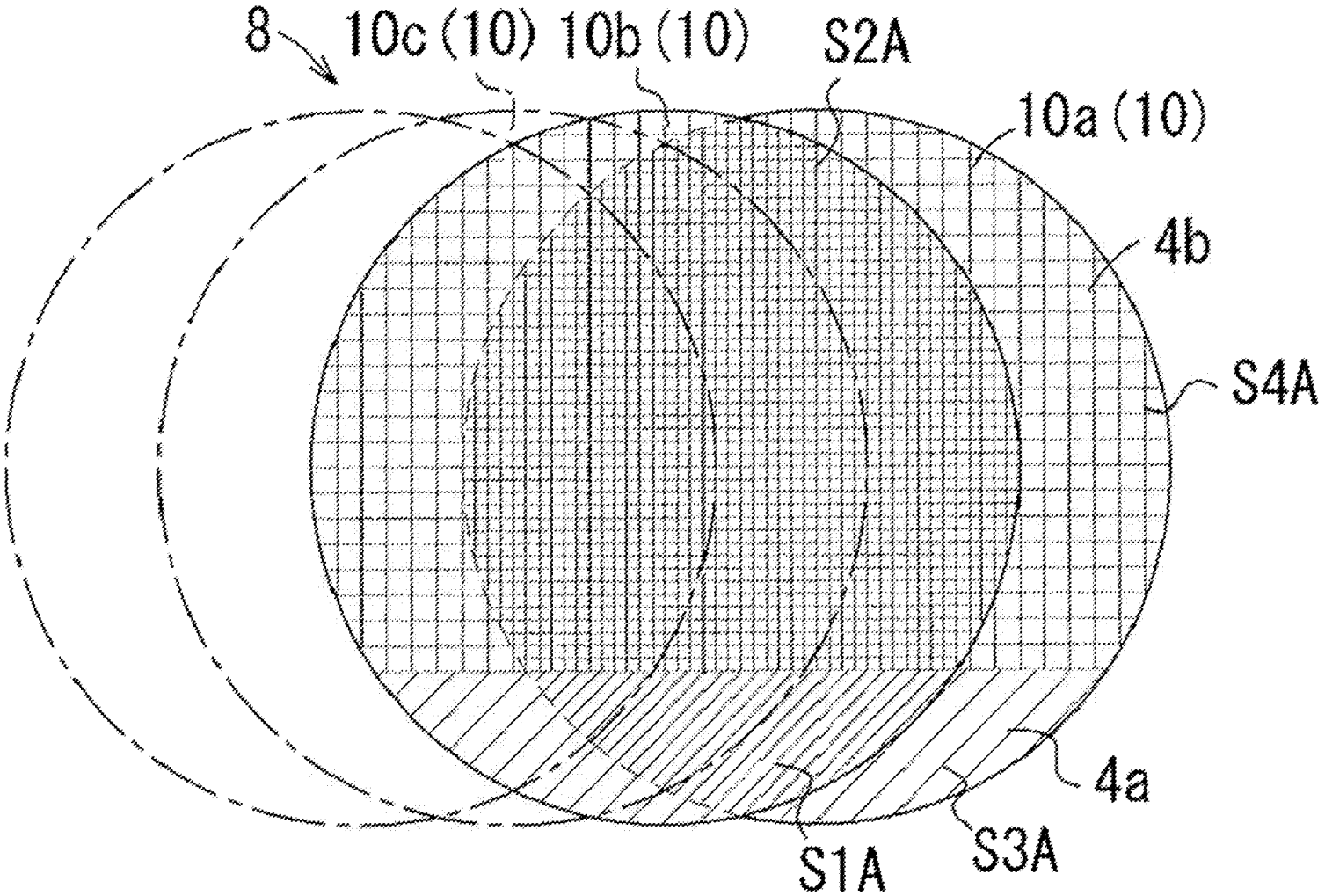
FIG. 3 is a schematic view as seen from the back surface of the band-shaped label set in which labels of the first embodiment of the present invention are connected.

Specifically, the band-shaped label set 8 is formed by sequentially adhering the rear end side regions of the first adhesive section 4*a* and the second adhesive section 4*b* formed on the back surface of a first label 10*a* to the tip end region of the overcoat layer 3 formed on the front surface of a second label 10*b* (the next label following the first label 10*a*), and then adhering the rear end side regions of the first adhesive section 4*a* and the second adhesive section 4*b* formed on the back surface of the second label 10*b* to the tip end region of the overcoat layer 3 formed on the front surface of a third label 10*c* (the next label following the second label 10*b*), as shown in FIG. 3.

With this configuration, regions S1A and S2A of each label 10 constituting the band-shaped label set 8, which are regions in the adhesive section (the first adhesive section 4*a* and the second adhesive section 4*b*) of the back surface that are in contact with the overcoat layer 3*a* of the front surface of the next label 10 of the same layer, adhere with the next label 10. Specifically, in each label 10 constituting the band-shaped label set 8, not only is the region S1A, which makes up part of the first adhesive section 4*a* functioning as an adhesive section when the label is attached to the adherend, adhered with the next label 10 of the same layer, but the region S2A which makes up part of the second adhesive section 4*b* is also adhered with the next label 10 of the same layer. Therefore, in the first embodiment, the labels 10 can be connected to each other with a stronger adhesive force than when a plurality of product advertisement labels of the prior art (labels in which the adhesive section is formed only on part of the back surface) are connected. The surface area of the adhesive regions (S1A+S2A) of adjacent connected labels 10 of the band-shaped label set 8 is preferably greater than 50% of the surface area of the entire back surface of a label 10. The labels 10 can be connected to each other with an even stronger adhesive force by connecting the labels 10 in this manner.

Figure 4:
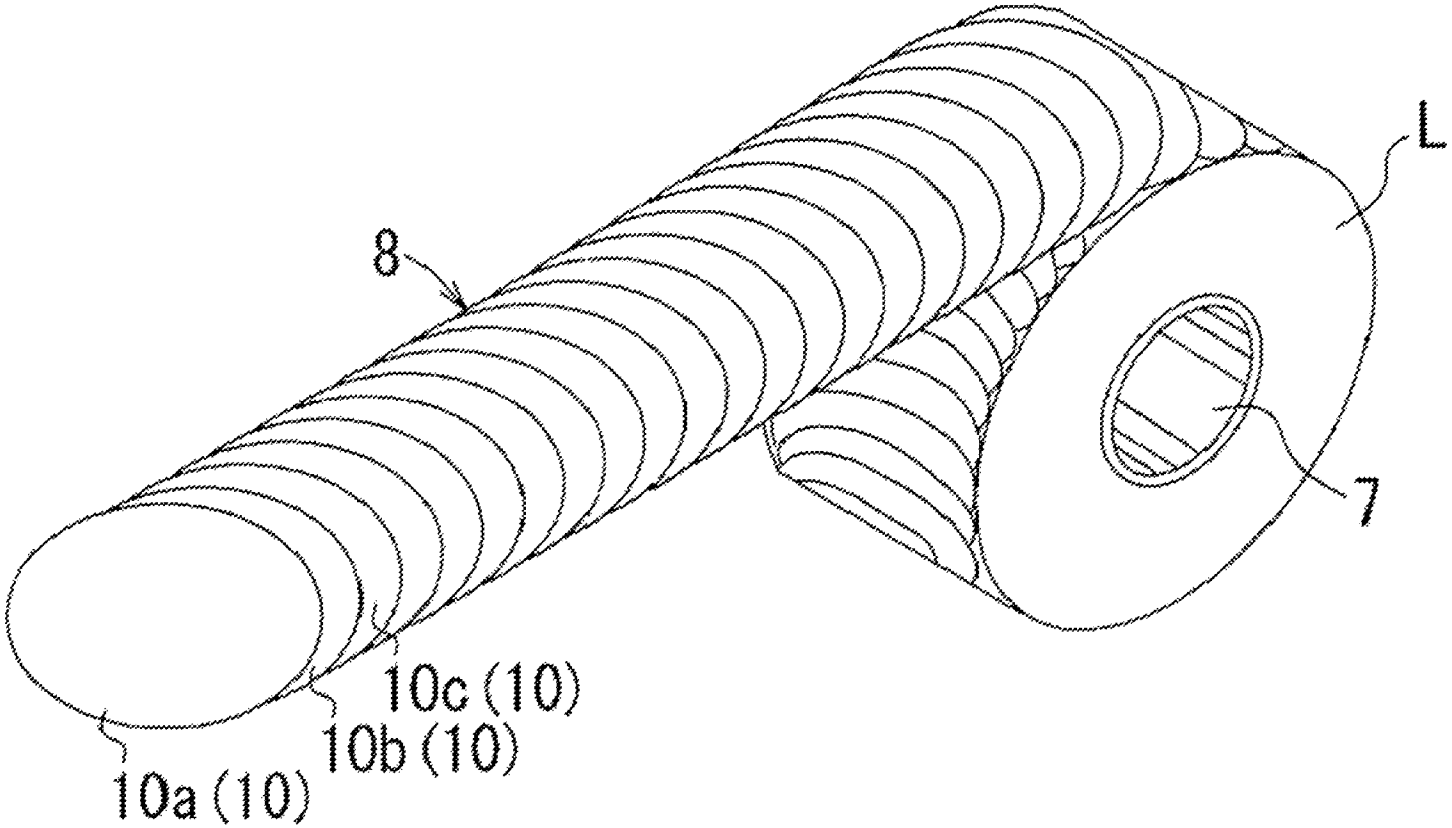
FIG. 4 is a schematic view showing an external view of the label roll of the first embodiment of the present invention.
Figure 5:
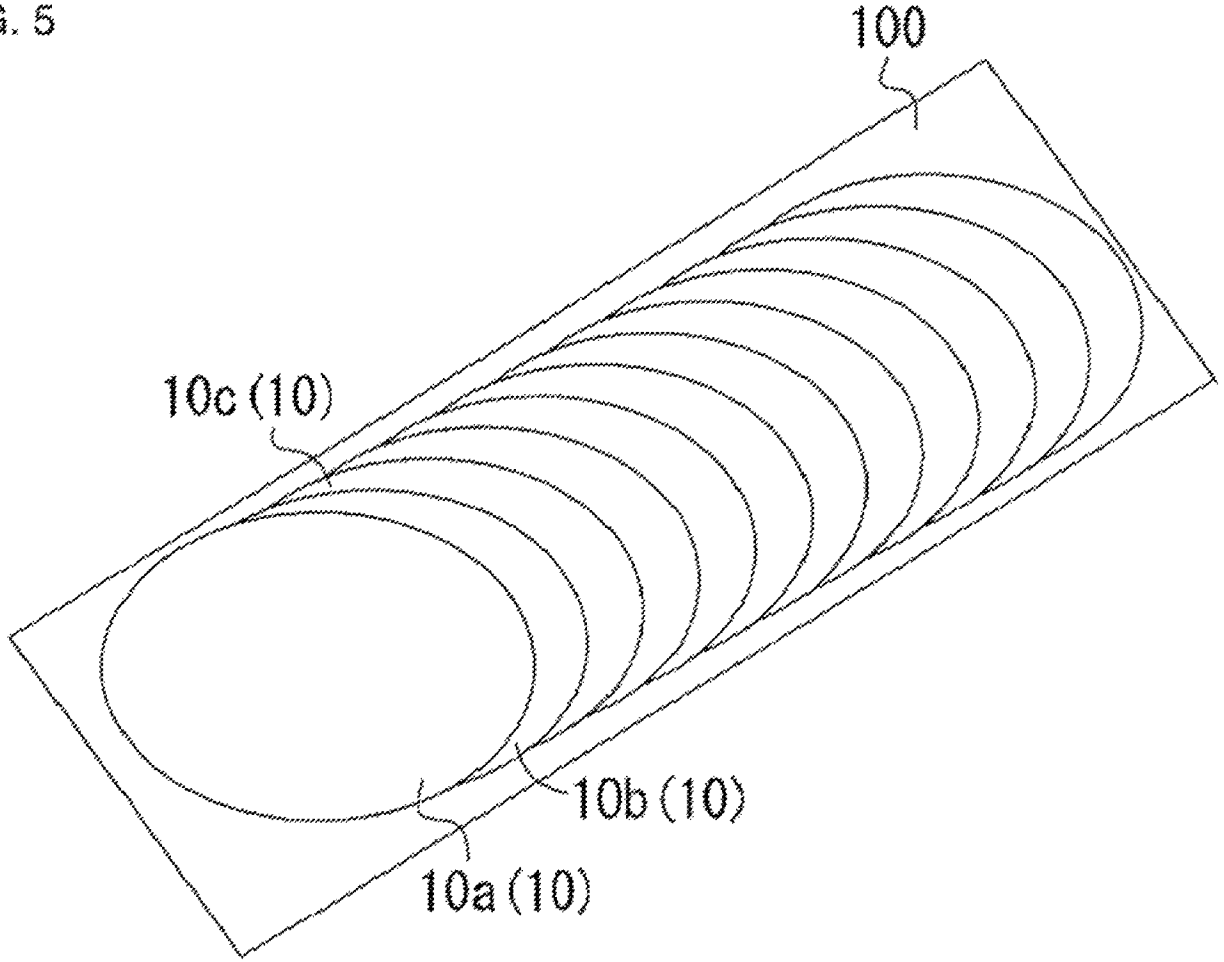
FIG. 5 is a schematic view showing a configuration in which release paper is attached to the band-shaped label set of the first embodiment of the present invention.

With the configuration of the label 10 of the first embodiment, it is possible to form a configuration that does not use release paper such as that of the label roll L shown in FIG. 4 described hereinafter, or to employ a configuration having release paper 100 attached to the back surface of the band-shaped label set 8 to reduce the amount of release paper, as shown in FIG. 5 described hereinafter. The following is a sequential description of the configuration of a label roll L configured using the label 10 of the first embodiment, and a configuration in which release paper 100 is attached to the band-shaped label set 8.

First, the label roll L will be described. The band-shaped label set 8 has a structure that makes it less likely to be cut off in the middle while being rolled up into a roll shape, compared with cases in which a plurality of product advertisement labels of the prior art (labels in which the adhesive section is formed only on part of the back surface) are connected. Therefore, in the first embodiment, a label roll L can be formed where the band-shaped label set 8 is rolled up into a roll shape around the core 7, as shown in FIG. 4. As a result, in the first embodiment, it is possible to provide a label roll L which does not use release paper in the labels 10 attached to the adherend with part of each label protruding, and the amount of waste matter can be reduced.

Specifically, the label roll L of the first embodiment is formed by rolling the band-shaped label set 8 into a roll shape around the core 7 after the second adhesive section 4*b* of each label 10 of the band-shaped label set 8 has cured. The region S1A that is part of the first adhesive section 4*a* and the region S2A that is part of the second adhesive section 4*b* are thereby adhered with the next label 10 of the same layer in each label 10 constituting the label roll L. In each label 10 constituting the label roll L, the region S3A of the first adhesive section 4*a* is adhered with a label 10 disposed in a lower layer.

Specifically, in the first embodiment, each label 10 constituting the label roll L is formed so that "the surface area of the region (region S1A=S2A) adhered with a label 10 connected in the same layer" is greater than "the surface area of the region S3A adhered with a label 10 disposed in a lower layer." In the example illustrated, the first adhesive section 4*a* is formed over a surface area about 20% of the entire back surface of the label 10, and the second adhesive section 4*b* is formed over a surface area about 80% of the entire back surface of the label 10. Therefore, the relationship "surface area of (region S1A+region S2A)"> "surface area of region S3A" is satisfied.

The strength of the adhesive force between labels 10 is correlated with the surface area of the adhered regions, and the adhesive force between labels 10 connected in the same layer is therefore greater than the adhesive force between labels 10 connected between an upper and lower layer in the first embodiment.

As a result, in the first embodiment, the labels 10 constituting the band-shaped label set 8 being drawn out remain without peeling away from labels 10 of a lower layer while the tip end of the label roll L (the tip end label 10) is pulled and the band-shaped label set 8 is being drawn out, and situations in which the band-shaped label set 8 is cut off are prevented. Specifically, provided in the first embodiment is a label roll L that is prevented from being cut off while the labels 10 are being drawn out.

Therefore, in the first embodiment, product advertisement labels 10 can be automatically attached to an adherend by using equipment for the self-adhering of labels. Specifically, with the configuration of the label roll L of the first embodiment, there is less of a possibility that the labels will be cut off when the equipment for the self-adhering of labels is drawing out the tip end of the label roll L, the process for the automatic self-adhering of the labels 10 will therefore not be frequently interrupted, and the process for the automatic self-adhering of the labels 10 can be performed efficiently.

The surface area percentage of the first adhesive section 4*a* and the second adhesive section 4*b* relative to the entire label is not particularly limited. When the label roll L is formed, the surface area percentage of the first adhesive section 4*a* and the second adhesive section 4*b* relative to the entire label is set so that "the surface area of the region (region S1A+S2A) adhered with a label 10 connected in the same layer" is greater than "the surface area of the region S3A adhered with a label 10 disposed in a lower layer."

Next, the configuration of the release paper 100 attached to the band-shaped label set 8 is described. Specifically, this is a configuration where the release paper 100 is attached to the back surface of the band-shaped label set 8 formed by connecting a plurality (twelve in the example illustrated) of labels 10, as shown in FIG. 5. FIG. 5 is a schematic view showing a configuration in which release paper is attached to the band-shaped label set of the first embodiment of the present invention.

In this illustrated configuration as well, the band-shaped label set 8 is connected with the front and back surfaces of a plurality of labels 10 disposed so as to partially overlap, and the size (surface area) of the release paper can therefore be smaller than when one sheet of release paper is attached at a time, as is the case in the partially pasted label of the prior art. As a result, the amount of waste matter can be reduced in the label 10 to be attached to the adherend with part of the label protruding.

Figure 6:
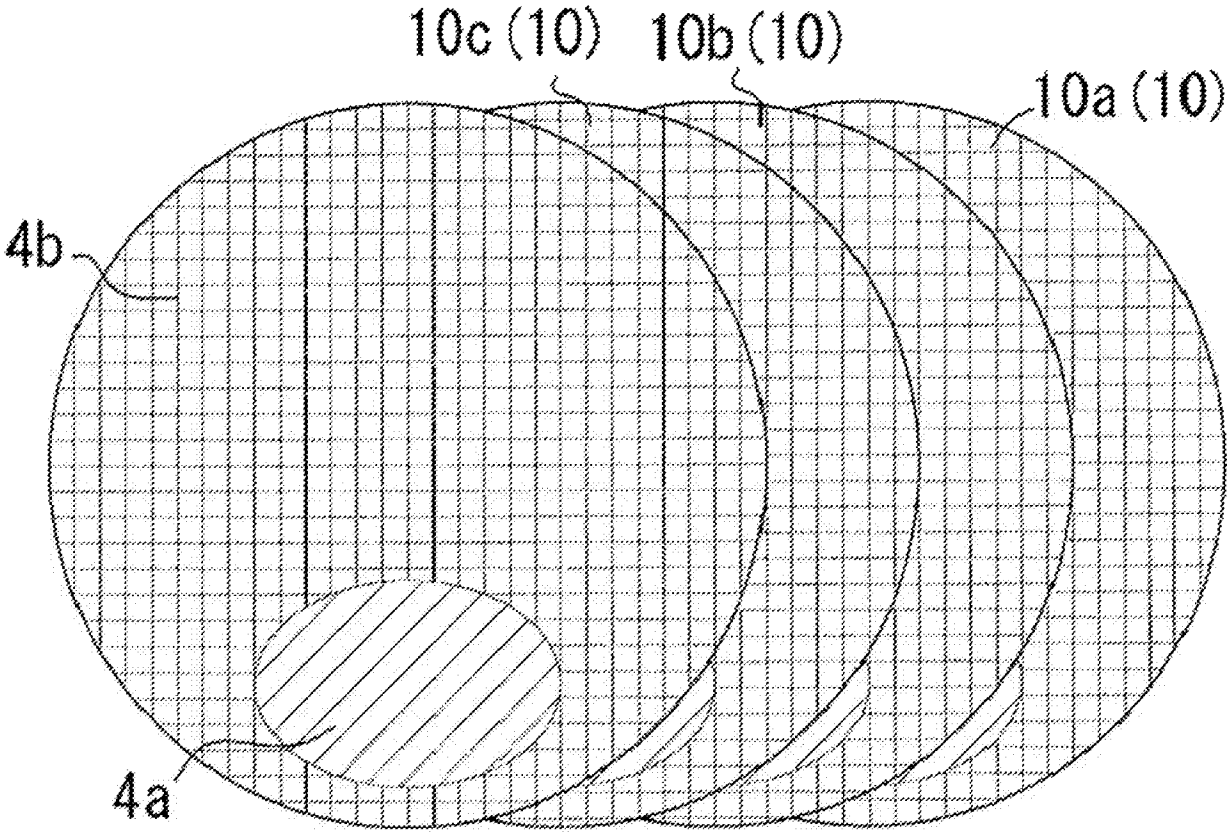
FIG. 6 is a schematic view showing a modification of the first embodiment of the present invention, as seen from the back surfaces of the labels.

In the first embodiment, the bottom end side region of the back surface of the label 10 is the first adhesive section 4*a* and the region other than the bottom end side is the second adhesive section 4*b*, but the label is not particularly limited as such. For example, an adhesive section 4*a* (an ellipsoidal adhesive section 4*a* in the example illustrated) may be formed in the middle of the bottom end side of the back surface of the label 10, and the region of the back surface of the label 10 other than the adhesive section 4*a* may be the second adhesive section 4*b*, as shown in FIG. 6. FIG. 6 is a schematic view showing a modification of the first embodiment, as seen from the back surfaces of the labels.

Thus, the region other than the first adhesive section 4*a* is the second adhesive section 4*b* even if the position and size of the first adhesive section 4*a* is set arbitrarily in accordance with the application of the label 10, and a band-shaped label set 8 in which labels are connected to each other with strong adhesive force can therefore be formed, similar to the first embodiment.

Figure 7:
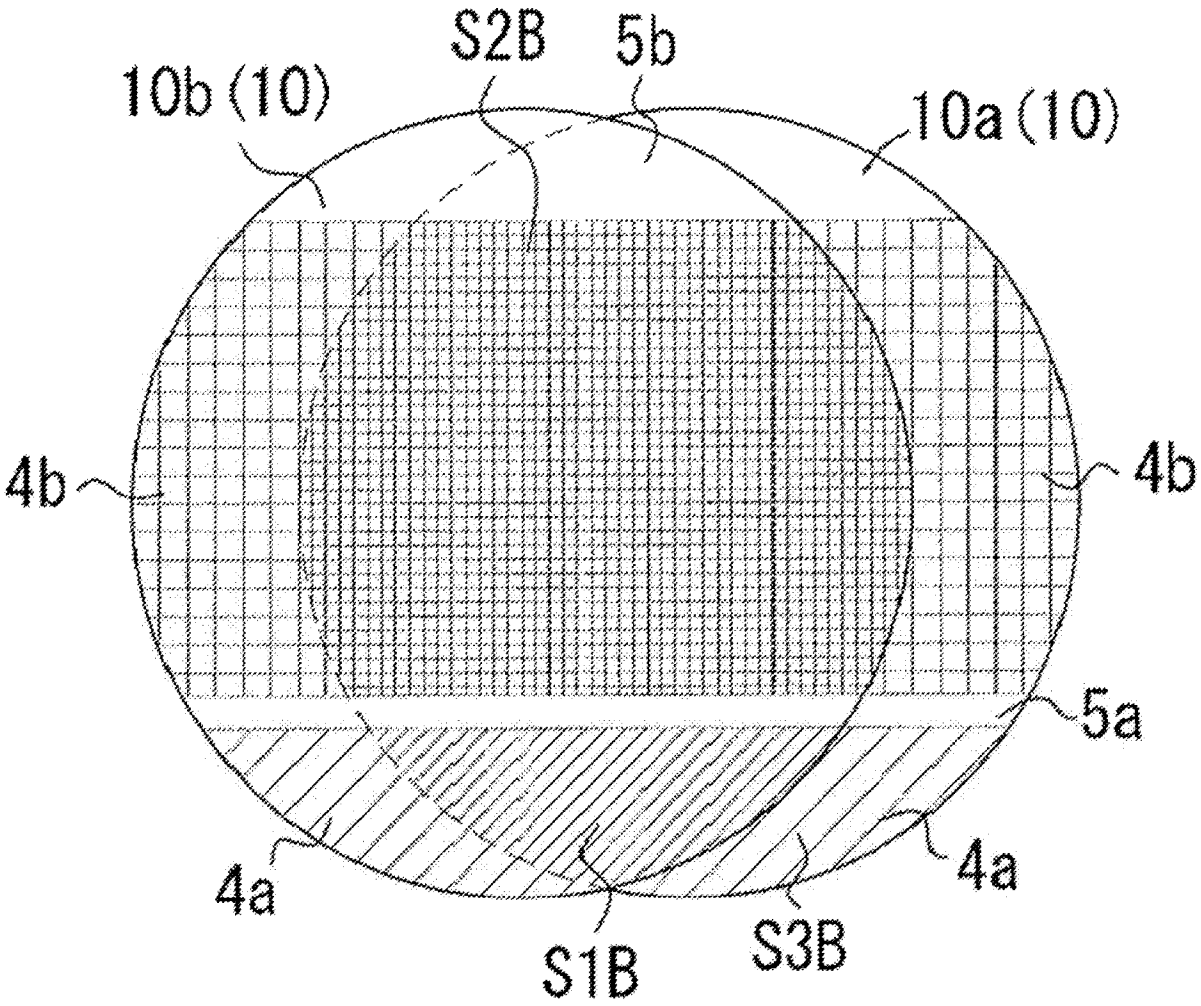
FIG. 7 is a schematic view for describing labels of the second embodiment of the present invention, as seen from the back surfaces of the labels.

Next, the second embodiment of the present invention is described. FIG. 7 is a schematic view for describing labels of the second embodiment of the present invention, as seen from the back surfaces of the labels. The second embodiment has the same configuration as the label 10 of the first embodiment aside from the configuration of the back surface. In the description of the second embodiment, configurations similar to and equivalent to those of the first embodiment use the same symbols.

On the back surface of the label 10 (the back surface of the label base section 2) of the second embodiment are formed a first adhesive section 4*a* coated with a first paste (self-adhesive paste) which remains self-adhesive, a second adhesive section 4*b* coated with a second paste (adhesive paste) which does not remain self-adhesive and cures after the elapsing of a predetermined time duration (e.g., 30 to 40 seconds) after coating, and paste-free sections 5*a*, 5*b* not coated with the paste (self-adhesive agent and adhesive), as shown in FIG. 7.

Specifically, the following sections are formed in the order listed and are disposed in parallel on the back surface of the label 10, from the bottom end side toward the top end side: the first adhesive section 4*a*, the paste-free section 5*a*, the second adhesive section 4*b*, and the paste-free section 5*b*. Specifically, the first adhesive section 4*a* is formed on the bottom end side region of the back surface of the label 10, the band-shaped paste-free section 5*a* is formed in a position adjacent to the top side of the first adhesive section 4*a*, the second adhesive section 4*b* is formed on the top side of the paste-free section 5*a*, and the paste-free section 5*b* is formed on the top side of the second adhesive section 4*b*.

The first adhesive section 4*a* of the second embodiment has a surface area of about 20% of the entire back surface of the label 10, similar to the first embodiment described above. The region where the second adhesive section 4*b* is formed has a greater surface area than the first adhesive section 4*a*. The region where the second adhesive section 4*b* is formed also has a greater surface area than the surface area of the region combining the paste-free section 5*a* and the paste-free section 5*b*.

Even in the configuration of the second embodiment, until the predetermined time duration (e.g., 30 to 40 seconds) has elapsed after the second adhesive section 4*b* is formed on the back surface of the label 10, the front and back surfaces of the plurality of labels 10 are disposed so as to partially overlap, and the band-shaped label set 8 in which labels 10 are connected to each other is formed by causing the overcoat layer 3 of the adjacently disposed next label 10 to adhere to the adhesive sections (the first adhesive section 4*a* and the second adhesive section 4*b*) formed on the back surfaces of all the labels 10. In the labels 10 constituting the band-shaped label set 8, the regions S1B, S2B of the back surface adhesive sections (the adhesive section 4*a* and the adhesive section 4*b*) that are in contact with the overcoat layer 3*a* of the front surface of the next label 10 in the same layer are adhered with the next label 10.

With the configuration described above, in the second embodiment well, not only is the region S1B of the first adhesive section 4*a* in each label 10 adhered with the next label 10 of the same layer, but the region S2B of the second adhesive section 4*b* is also adhered with the next label 10 of the same layer. Therefore, in the second embodiment as well, the labels 10 can be connected to each other with a stronger adhesive force than when a plurality of product advertisement labels (labels in which the adhesive section is formed only on part of the back surface) of the prior art are connected.

In the second embodiment as well, after the second adhesive section 4*b* of each label 10 of the band-shaped label set 8 is cured, the same operational effects as the first embodiment described above are achieved by wrapping the band-shaped label set 8 around a core 7 to form the label roll L.

Specifically, in the second embodiment, the labels 10 constituting the label roll L are configured so that "the surface area of the region (region S1B+region S2B) adhered with labels 10 connected in the same layer" is greater than "the surface area of the region S3B (region of the adhesive section 4*a* excluding the region S1B) adhered with labels 10 connected between upper and lower layers." Therefore, in the label roll L of the second embodiment as well, the adhesive force between labels 10 connected in the same layer is greater than the adhesive force between labels 10 connected between upper and lower layers.

As a result, in the second embodiment as well, while the tip end of the label roll L (the tip end label 10) is pulled and the band-shaped label set 8 is being drawn out, situations are provided in which the labels 10 constituting the band-shaped label set 8 remain on lower-layer labels 10 without peeling away and the band-shaped label set 8 is cut off.

In the second embodiment, the amount of second paste (adhesive) for forming the second adhesive section 4*b* is reduced because the surface area over which the second adhesive section 4*b* is formed can be made smaller than with the first embodiment. As a result, production costs in the second embodiment can be lower than in the first embodiment.

Figure 8:
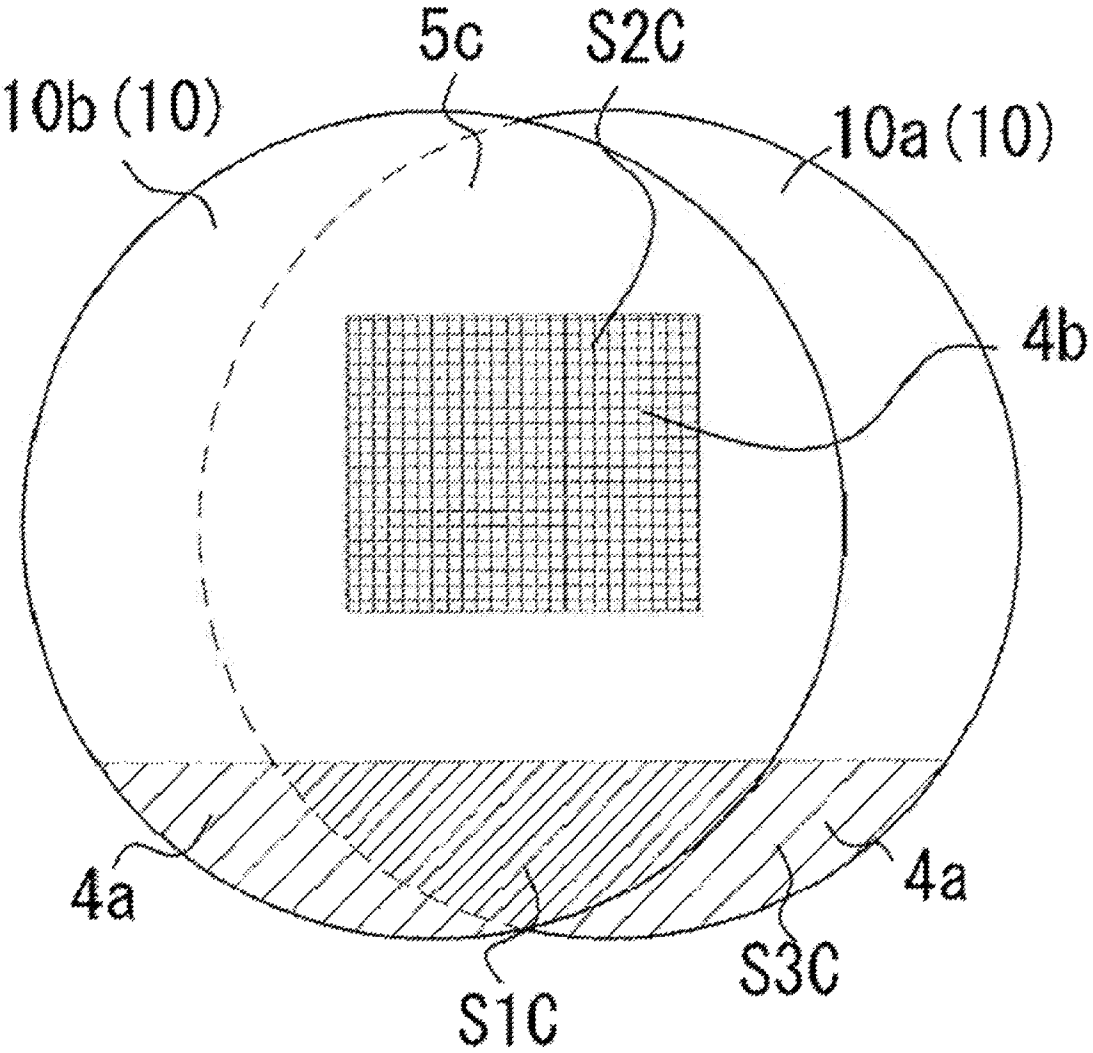
FIG. 8 is a schematic view showing a modification of the second embodiment of the present invention, as seen from the back surfaces of the labels.

The same effects of the second embodiment are achieved even if the label roll of the second embodiment is configured as shown in FIG. 8. FIG. 8 includes schematic views showing a modification of the second embodiment of the present invention, and these schematic views are of the labels as seen from the back surface.

In the modification illustrated, the first adhesive section 4*a* coated with a first paste (self-adhesive paste) that remains self-adhesive is formed in the bottom end side region of the back surface of the label 10. The second adhesive section 4*b*, coated with a second paste (adhesive paste) which does not remain self-adhesive and cures when a predetermined time duration (e.g., 30 to 40 seconds) elapses after coating, is formed approximately in the middle of the back surface of the label. The region of the back surface of the label 10 excluding the first adhesive section 4*a* and the second adhesive section 4*b* is a paste-free section 5*c*. In the present modification, the second adhesive section 4*b* is formed in a region of the back surface of each label 10 that overlaps the overcoat layer 3 of the next label 10 when the front and back surfaces of the plurality of labels 10 are disposed so as to partially overlap, this region being above the first adhesive section 4*a*.

In each label 10 constituting the band-shaped label set 8 in the present modification, the regions S1C, S2C of the first adhesive section 4*a* and second adhesive section 4*b* of the back surface that are overlaid on and in contact with the overcoat layer 3*a* of the front surface of the next label 10 in the same layer are adhered with the next label 10. Thus, in each label 10 constituting the band-shape label set 8, not only is the region S1A, which makes up part of the first adhesive section 4*a* functioning as the adhesive section when attached to the adherend, adhered with the next label 10 of the same layer, but the region S2C which makes up the entire second adhesive section 4*b* is also adhered with the next label 10 of the same layer. When the band-shaped label set 8 is wrapped into a roll shape to constitute the label roll L, the region S3C (the region of the first adhesive section 4*a* excluding the region S1C) in each label 10 is adhered with a lower-layer label 10.

In the present modification as well, each label 10 constituting the label roll L is configured so that "the surface area of the region (region S1C+region S2C) adhered with a label 10 in the same layer" is greater than "the surface area of the region S3C (the region of the adhesive section 4*a* excluding the region S1B) adhered with a label 10 in a lower layer." In the modification of the second embodiment, the surface area over which the second adhesive section 4*b* is formed is less than in the second embodiment shown in FIG. 7, but the surface area over which the second adhesive section 4*b* is formed is set as appropriate in accordance with the size and shape of the label 10.

In the modification of the second embodiment as well, the same effects as the second embodiment described above are achieved, and production costs can be lowered because the amount of second paste (adhesive) for forming the second adhesive section is reduced even further than in the second embodiment.

The present invention is not limited to the embodiments described above (the first and second embodiments), and various changes can be made within the range of the scope thereof.

For example, in the embodiments described above (the first embodiment and the second embodiment), the label 10 is formed into a circular shape, but the shape of the label 10 is designed as appropriate. The above-described paste-free sections 5*a*, 5*b*, 5*c* may be formed by performing "so-called detackifying."

The following is a list of reference numerals and associated parts as used in this specification and drawings:

| Reference Numeral | Part |
|---|---|
| L | label roll |
| 2 | label base section |
| 3 | overcoat layer |
| 4a | first adhesive section |
| 4b | second adhesive section |
| 5a | paste-free section |
| 5b | paste-free section |
| 5c | paste-free section |
| 7 | core |
| 8 | band-shaped label set |
| 10 | label |
| 10a | label |
| 10b | label |
| 10c | label |

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention. The scope of the claims should not be limited by the preferred embodiments and examples, but should be given the broadest interpretation consistent with the written description as a whole.

What is claimed is:

1. A method for arranging labels, comprising the steps of:

a) forming a plurality of labels, wherein each label is formed by the steps of:
   i) forming a label base section with front and back surfaces;
   ii) providing an overcoat layer on the front surface of the label base section;
   iii) forming a first adhesive section on the back surface of the label base section by coating a first paste on a portion of the back surface of the label base section; the first paste remaining self-adhesive;
   iv) forming a second adhesive section on the back surface of the label base section by coating a second paste on another portion of the back surface of the label base section; wherein the second paste cures, so as to become non-adhesive, after the elapsing of a predetermined time duration after being coated on the another portion of the back surface of the label base section;

b) forming a band-shaped label set, prior to the elapsing of the predetermined time duration, by connecting the plurality of labels to each other by disposing the front and back surfaces of the labels so as to partially overlap each other, and causing the overcoat layer of the next adjacently disposed label to adhere to the first and second adhesive sections formed on the back surface of each label base section; and c) rolling up the band-shaped label set into a label roll after the elapsing of the predetermined time duration.

2. The method of claim 1, wherein the first paste is formed from a rubber hot melt adhesive or a UV-curing acrylic hot melt adhesive.

3. The method of claim 1, wherein the second paste is formed from an olefin adhesive.

4. The method of claim 1, further comprising the step of forming a paste-free section on the back surface of the label base section.

5. A method for arranging labels, comprising the steps of:

a) forming a plurality of labels, each label being formed by the steps of:
   i) forming a label base section with front and back surfaces;
   ii) providing an overcoat layer on the front surface of the label base section;
   iii) forming a first adhesive section on the back surface of the label base section by coating a first paste on a portion of the back surface of the label base section; the first paste remaining self-adhesive;
   iv) forming a second adhesive section on the back surface of the label base section by coating a second paste on another portion of the back surface of the label base section; wherein the second paste cures, so as to become non-adhesive, after the elapsing of no more than about 40 seconds after being coated on the another portion of the back surface of the label base section;

b) forming a band-shaped label set, prior to the elapsing of said no more than about 40 seconds, by connecting the plurality of labels to each other by disposing the front and back surfaces of the labels so as to partially overlap each other, and causing the overcoat layer of the next adjacently disposed label to adhere to the first and second adhesive sections formed on the back surface of each label base section; and c) attaching release paper to the back surfaces of the connected labels in the band-shaped label set.

* * * * *